US005184821A

United States Patent [19]

Korenek

[11] Patent Number: 5,184,821

[45] Date of Patent: Feb. 9, 1993

[54] GAME APPARATUS FOR POKER AND SIMILAR CARD GAMES

[76] Inventor: Raymond E. Korenek, Rte. 2, Box 23, McGregor, Tex. 76657

[21] Appl. No.: 817,645

[22] Filed: Jan. 7, 1992

[51] Int. Cl.[5] ..... A63F 5/00; A63F 9/24

[52] U.S. Cl. ..... 273/138 A; 273/142 A; 273/85 CP; 273/142 R; 273/142 B; 273/274; 273/280

[58] Field of Search ..... 273/138 R, 138 A, 85 CP, 273/141 R, 141 A, 142 R, 142 A, 142 B, 142 C, 142 D, 142 H, 142 HA, 142 J, 142 JA, 274, 280

[56] References Cited

U.S. PATENT DOCUMENTS

| | | | |
|---|---|---|---|
| 636,508 | 11/1899 | Eickershoff | 273/142 H |
| 696,735 | 4/1902 | Heidinger . | |
| 1,689,380 | 10/1928 | de Bary . | |
| 1,708,472 | 4/1929 | Fulgora | 273/142 H |
| 3,975,022 | 8/1976 | Figueroa | 273/142 JA |
| 4,149,728 | 4/1979 | Thompson . | |
| 4,441,714 | 4/1984 | Goott | 273/274 |
| 4,492,378 | 1/1985 | Williams . | |
| 4,732,386 | 3/1988 | Rayfiel . | |
| 4,941,665 | 7/1990 | Klamer . | |

FOREIGN PATENT DOCUMENTS

| | | |
|---|---|---|
| 842772 | 6/1952 | Fed. Rep. of Germany . |
| 706881 | 4/1931 | France . |
| 1532009 | 5/1968 | France . |
| 610208 | 4/1979 | Switzerland . |

*Primary Examiner*—William H. Grieb
*Assistant Examiner*—Jessica J. Harrison
*Attorney, Agent, or Firm*—Richard C. Litman

[57] ABSTRACT

Disclosed is a game apparatus for playing poker and similar card games, including a playing table having a plurality of images which may be selectively lit to indicate winning bets, an indicator board to indicate identified cards, and a switchboard for controlling the playing table. Also disclosed are a plurality of rotatable wheels driven by an electric motor and a plurality of different size sprockets connected to the electric motor by a series of chains, whereby the plurality of rotatable wheels may be simultaneously driven at different speeds of rotation. The rotatable wheels include a large wheel having randomly selected images of a complete deck of cards plus a Joker, the suits being arranged to alternate a red and a black card, and four smaller wheels mounted on the large wheel and having randomly selected images of thirteen cards from a second deck, the suits being arranged in a manner similar to the large wheel. Spring markers cooperate with pins on said wheel to identify selected cards.

18 Claims, 4 Drawing Sheets

GAME APPARATUS FOR POKER AND SIMILAR CARD GAMES

BACKGROUND OF THE INVENTION

1. Field of the Invention

This invention relates to a game apparatus, and more particularly to a game apparatus for playing poker and similar card games, including playing card indicia on a plurality of rotatable wheels in combination with a playing table.

2. Description of Related Prior Art

Game apparatus using rotatable wheels and playing card indica are well known in the prior art. U.S. Pat. No. 696,735 issued Apr. 1, 1902, to Louis C. Heidinger, U.S. Pat. No. 1,689,380 issued Oct. 30, 1928 to Ervin Gustave de Bary, U.S. Pat. No. 4,492,378 issued Jan. 8, 1985 to Daniel W. Williams, U.S. Pat. No. 4,732,386 issued Mar. 22, 1988 to Howard Rayfiel, U.S. Pat. No. 4,941,665 issued Jul. 17, 1990 to Reuben B. Klamer, French Patent No. 1,532,009 issued May 27, 1968 to Pierre Gilbert et al., German Patent No. 842,772 issued Jun. 30, 1952 to Alexander Siewert, and Swiss Patent No. 610,208 issued Apr. 12, 1979 to Magden Madardo Ceresola disclose games of chance using two or more wheels. U.S. Pat. No. 4,149,728 issued Apr. 17, 1979 to Richard G. Thompson, and French Patent No. 706,881 issued Apr. 4, 1931 disclose games of chance using a single wheel. Of the above cited patents, only de Bary, Thompson, William and Gilbert et al. teach the use of wheels for playing card games such as poker. Thompson, Williams and Gilbert et al. also teach the use of a game board in combination with the wheel or wheels. Rayfiel teaches the use of an electric motor and gearing interconnection between a central wheel 12 and a plurality of smaller wheels 2, 4, 6, 8 and 10 disposed externally of the circumference of the central wheel 12 and driven by said central wheel 12 through a gear interconnection.

SUMMARY AND OBJECTS OF THE INVENTION

The game apparatus disclosed herein comprises a large rotatable wheel having the image of 53 cards disposed around the outer portion of the large wheel adjacent the circumference, the cards including a full deck plus a joker. Rotatably mounted and evenly dispersed on the large wheel are four smaller wheels each carrying the image of 13 cards, the four smaller wheels together displaying a second complete deck. Centrally disposed between the four smaller wheels coaxially with the large wheel is a marker wheel carrying four flexible spring markers arranged to identify a card image on each of the smaller wheels. A fifth flexible spring marker is suitably located above the large wheel to identify a card on the large wheel. The wheels and markers are mounted on a movable stand together with an electric motor which, through a chain and sprocket connection further described below, drives the wheels at variable rates, the motor being selectively controlled by an operator. When the wheels stop the respective markers indicate card combinations as in various poker games such as five card stud and seven card stud. The cards are arranged in random order; however, suits are arranged in the order of diamond, club, heart and spade.

A playing table is provided with the wheels to enable players to indicate their bets by placing chips or the like on various images on the table top. The dealer can control the length of time the wheels are rotated by an on and off switch connected to the electric motor. Located at one end of the table adjacent the rotatable wheels is a vertical indicator board controlled by the dealer and capable of showing lighted images representative of the cards indicated by the respective markers on the wheels. A control panel is mounted on the side of the table to enable the dealer to not only control the vertical indicator board, but also to illuminate those images on the table having winning bets thereon.

Accordingly, it is an object of this invention to provide a game apparatus for poker and similar card games using motor driven rotatable wheels.

It is another object of this invention to provide a game apparatus for poker and similar card games wherein the rotatable wheels are driven at variable rates of speed.

It is a still further object of this invention is to provide a game board enabling bettors to bet on various combinations of cards.

Other objects, features and advantages of this invention will become apparent from the following detailed description and the appended claims, reference being had to the accompanying drawings forming a part of the specification, wherein like reference numerals designate corresponding parts of the several views.

DETAILED DESCRIPTION OF THE PREFERRED EMBODIMENT

Before explaining in detail the present invention, it is to be understood that the invention is not limited in its application to the details of construction and arrangement of pars illustrated in the accompanying drawings, since the invention is capable of other embodiments and of being practiced or carried out in various ways. Also, it is to be understood that the phraseology and terminology employed herein is for the purpose of description and not limitation.

Figure 1:
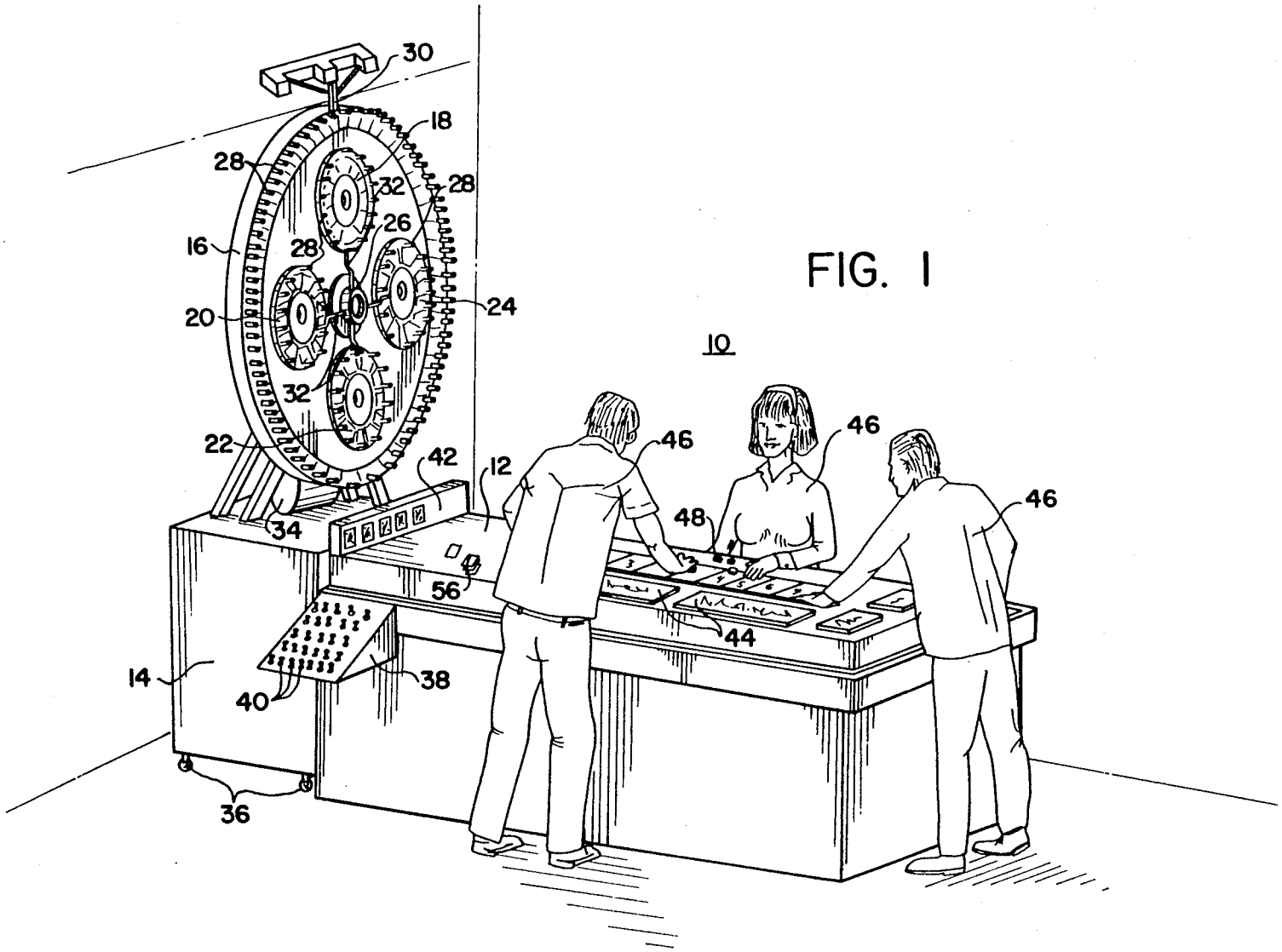
FIG. 1 is an environmental perspective view showing the game apparatus in use.

Turning now to FIG. 1, the major components of the game apparatus 10 are shown in use. Apparatus 10 comprises a playing table 12, and a movable stand 14 having mounted thereon a large rotatable wheel 16 carrying four smaller rotatable wheels 18, 20, 22, 24 and a rotatable marker wheel 26. The large rotatable wheel 16 and the four smaller rotatable wheels 18, 20, 22 and 24 carry pins 28 thereon which respectively cooperate with a stationary spring marker 30 mounted above the large rotatable wheel 16 and spring markers 32 carried by rotatable marker wheel 26, so as to identify individual playing cards carried around the perimeter of each wheel 16, 18, 20, 22, 24 when the wheels 16, 18, 20, 22, 24 are stopped. The wheels are driven by a motor 34 mounted on stand 14.

Also shown in FIG. 1, are casters 36 supporting stand 14 for movement, a switch board 38 having a plurality of switches 40 thereon controlled by the dealer, an enunciator or indicator board 42, and marked areas 44 of the playing table 14 enabling players 46 to indicate their bets with chips 48. One of the switches 40 on switch board 38 is connected to operate motor 34 which, through sprocket and chain connections described hereinafter, rotates wheels 16, 18, 20, 22, 24 and 26 for any desired period of time at the discretion of the operator, usually the dealer. The wheels 18–26 coast to a halt soon after power to motor 34 is disconnected. Once the wheels 18–26 have stopped rotating the dealer, by selectively operating switches 40, indicates which cards are identified by spring markers 30 and 32 on the large rotatable wheel 18 and the smaller rotatable wheels 18, 20, 22 and 24 on the enunciator or indicator board 42 as by means of conventional light emitting diodes (LEDS). Selected marked areas 44 of playing table 14 corresponding to the identified cards are simultaneously lit, thereby enabling the dealer to readily identify winning and losing bets.

Figure 2:
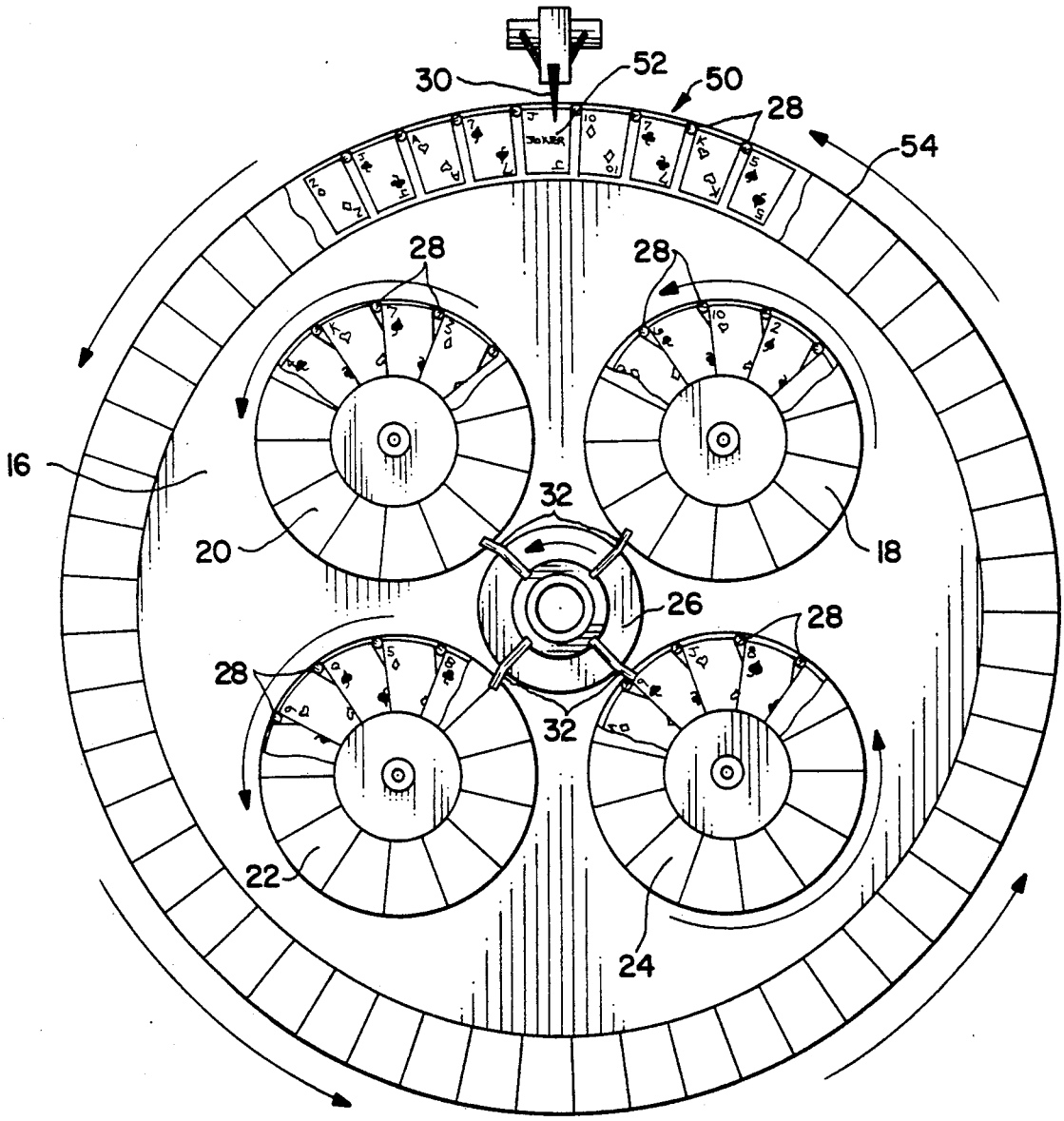
FIG. 2 is a front view showing the large wheel with a cooperating marker, and four smaller wheels and marker wheel mounted on the large wheel.

FIG. 2 provides a close-up view of the arrangement of the cards on the large rotatable wheel 16 and the four smaller rotatable wheels 18, 20, 22 and 24. As shown, the large rotatable wheel 16 has a complete deck of fifty-two cards 50 plus a Joker 52 displayed around the periphery 54 thereof. A second complete deck of cards 50 is evenly divided, thirteen cards each, among the four smaller rotatable wheels 18, 20, 32, and 24. While the cards are arranged in random order on each of the wheels 16–24, the suits are arranged in the order of Diamond, Club, Heart and Spade as shown so as to alternate a red and a black card around the periphery of each wheel to the extent possible. Each of the wheels 16, 18, 20, 22, 24 and marker wheel 26 when rotating rotate in the counterclockwise direction as indicated in FIG. 2.

Figure 3:
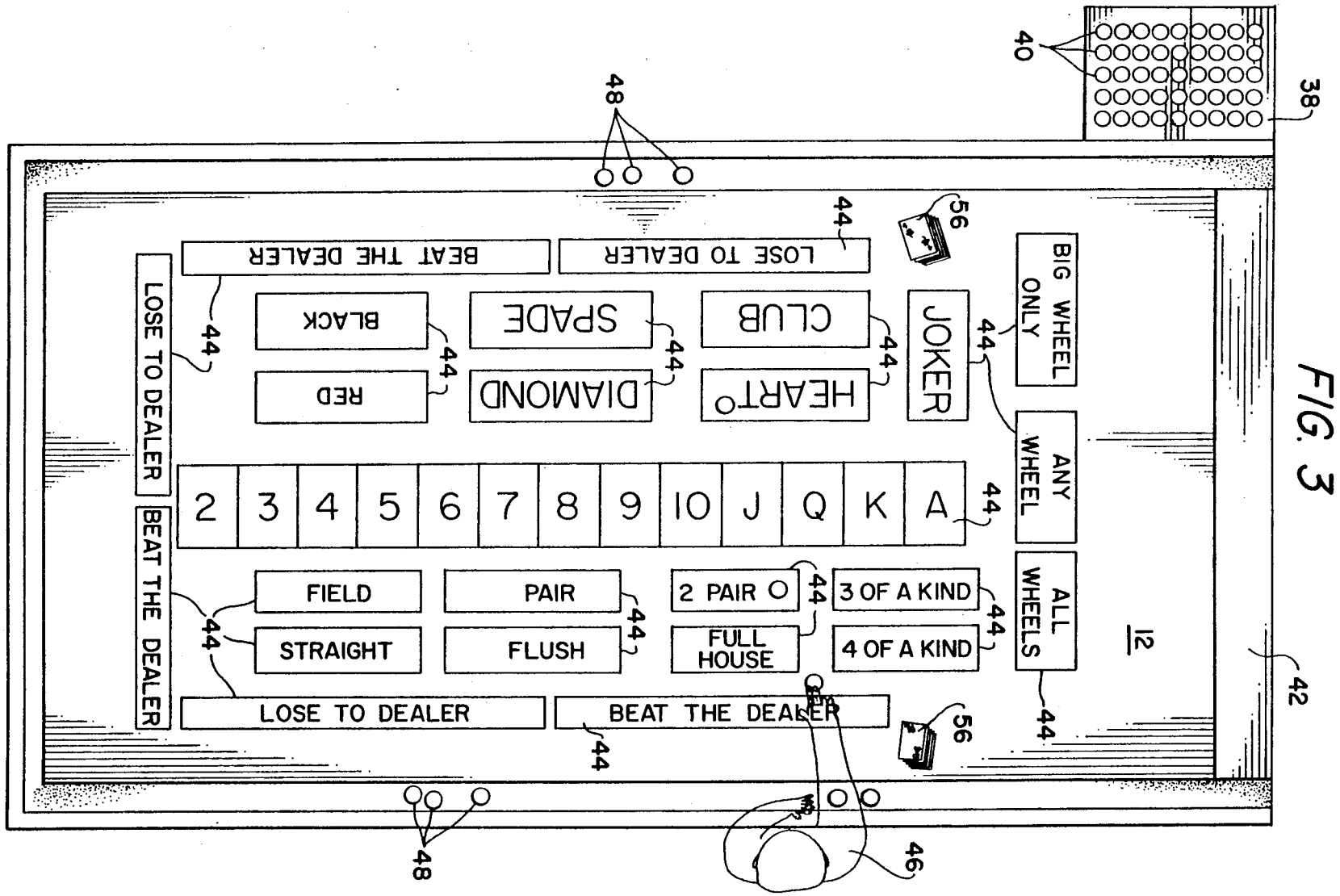
FIG. 3 is a top view of the playing table.
Figure 5:
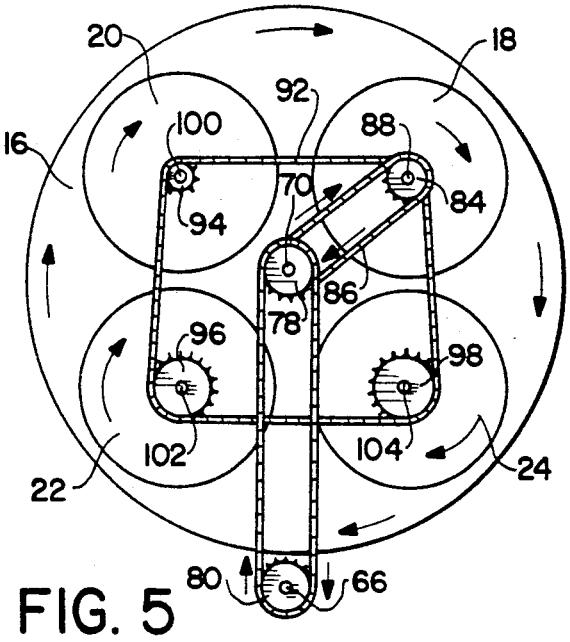
FIG. 5 is a back view showing varying sizes of respective sprockets and drive chain connections thereto for driving the respective wheels at variable speeds.
Figure 6:
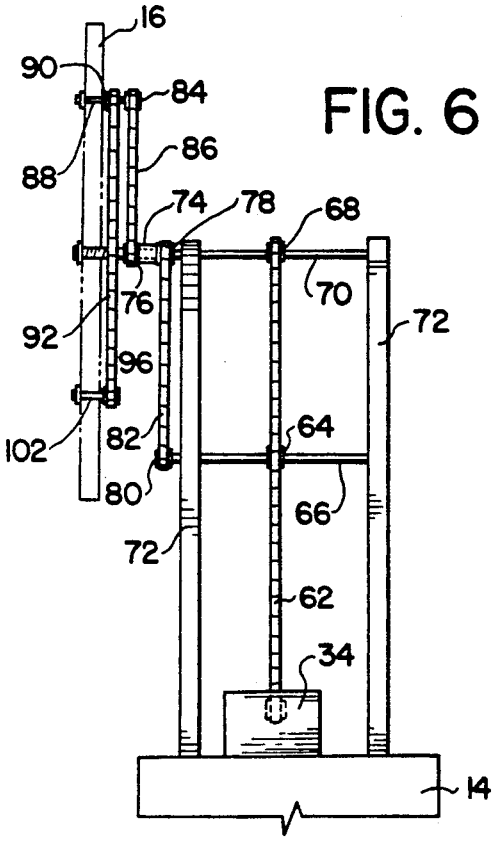
FIG. 6 is a side view of the drive train for the respective wheels.
Figure 7:
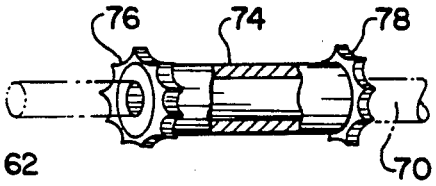
FIG. 7 is a perspective view of a bushing mounted on the main shaft and integral with two sprockets carried thereon.

FIG. 3 is a top view of playing table 12 showing the marked areas 44 on which a player 46 may place a chip or chips 48 to indicate his or her bet. On the right side of the playing table 12 the marked areas 44 indicate various poker hands, as in five card stud, the central marked area 44 indicating which cards are identified by the markers 30, 32, on wheels 16–24. The marked areas 44 on the left side of playing table 12 as well as around the periphery thereof indicate other types of bets that can be made. For example, a player might bet that a card indicated on the large or big wheel 16 will be a Joker, or a Heart, or a red card, or a black card, or six of spades, etc. As an alternative, after the wheels 16–26 are spun once, each player 46 might bet that the indicated cards will beat the dealer or lose to the dealer. The dealer's hand is determined by a second spin of the wheels 16–26. Another optional game that can be played with the disclosed apparatus 10 is seven card stud, in which the dealer deals two cards 56 face down to each player 46 including himself, which cards 56 are combined with the five cards indicated by the markers 30, 32, on the rotatable wheels 16–24 to make the various hands.

Each winning card or combination of cards would have payoffs related to the relative difficulty of having that card or combination of cards in a hand. For example: a Joker would pay 50 to 1; a Spade, Heart, Diamond or Club would pay 3 to 1; a red or black card would pay 1 to 1; a pair would pay 1 to 1; two pairs would pay 10 to 1; three of a kind would pay 12 to 1; a straight would pay 20 to 1; a flush would pay 22 to 1; a full house would pay 60 to 1; a field (any hand less than 1 pair) would pay 1 to 1; a two-ace on any of the five wheels 16–24 would pay 2 for 1; and beat or lose to the dealer would pay 1 to 1.

Figure 4:
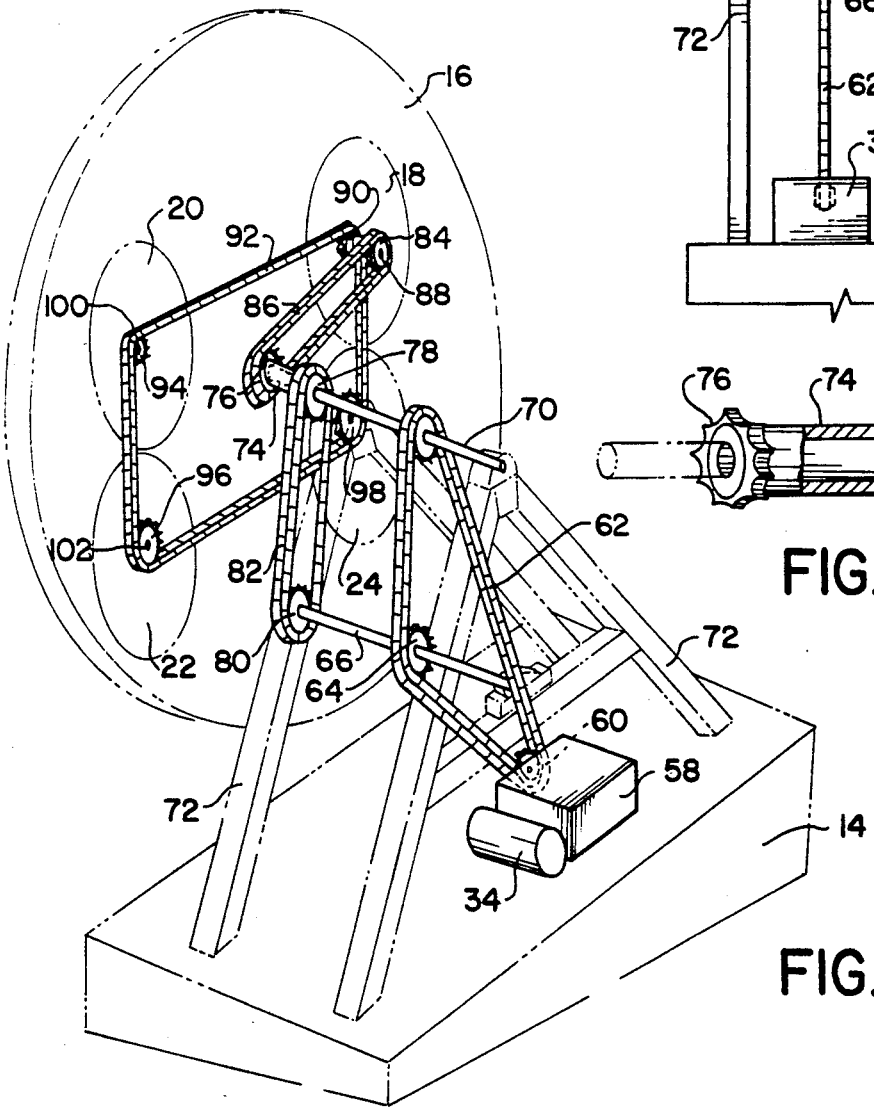
FIG. 4 is a perspective back view of the drive mechanism for rotating the respective wheels.

FIGS. 4–7, inclusive, show the drive structure for rotating wheels 16–26. In FIG. 4, motor 34 is shown to be connected to a conventional reduction gear box 58 which in turn has a conventional sprocket 60 connected thereto to be driven by motor 34. Sprocket 60 drives a first chain 62 which in turn engages and drives a second sprocket 64 secured on a second shaft 66 and a third sprocket 68 secured on a main shaft 70. Second shaft 66 and a main shaft 70 are supported by two A-frames 72 mounted on stand 14. Main shaft 70 also has the large rotatable wheel 16 and the rotatable marker wheel 26 mounted thereon for rotation therewith when the third sprocket 68 rotates main shaft 70. Main shaft 70 also rotatably supports a bushing 74 having a fourth and a fifth sprocket 76, 78 respectively, integral with each end thereof. A sixth sprocket 80 is connected to one end of second shaft 66 for rotation with shaft 66. A second chain 82 connects sixth sprocket 80 with fifth sprocket 78, thereby rotating bashing 74 relative to main shaft 70 whenever second shaft 66 is rotated. Fourth sprocket 76 on bashing 74 is connected to a seventh sprocket 84 by a third chain 86. Seventh sprocket 84 is mounted on a shaft 88 supporting the first smaller rotatable wheel 18. Shaft 88 is integral with a width sprocket 90 which connects width sprocket 90 with a ninth sprocket 94, a tenth sprocket 98 respectively connected to shafts 100. 102 and 104 integral respectively with the second smaller rotatable wheel 24. Sprockets 68, 90, 94, 96 and 98 are chosen to be of different sizes, whereby the respective wheels 16–24 respectively rotate at different rates of speed. For example, the large rotatable wheel 16 may rotate at a rate of 70 to 84 RPM, the first smaller rotatable wheel 18 may rotate at a rate of 60 to 70 RPM, the second smaller rotatable wheel 20 may rotate at a rate of 75 to 80 RPM, the third smaller rotatable wheel 22 may rotate at a rate of 85 to 90 RPM, and the fourth smaller rotatable wheel 24 may rotate at a rate of 95 to 100 RPM, depending on the size of the sprockets selected. It should be noted that as the large rotatable wheel 16 rotates, the third and fourth chains 86, 92 together with the sprockets driven thereby will also rotate about main shaft 70.

While it will be apparent that the preferred embodiment of the invention herein disclosed is well calculated to fulfill the objects above-stated, it will be appreciated that the invention is susceptible to modification, variation and change without departing from the proper scope or fair meaning of the subjoined claims.

I claim:

1. A game apparatus for poker and similar card games comprising:

a playing table having a plurality of marked areas indicative of betting options;

an indicator board located at one end of said playing table for indicating selected cards to players around said playing table;

a switchboard having a plurality of switch means thereon for activating said indicator board and for selectively illuminating portion of said marked areas indicative of winning bets, said switchboard being operated by a dealer;

a large rotatable wheel mounted on a movable stand, said movable stand being suitably connected to said playing table, said large rotatable wheel having randomly arranged indicia around the periphery of a front surface thereof indicative of a complete first deck of cards and Joker;

a plurality of smaller rotatable wheels pivotally mounted on said front surface of said large rotatable wheel for rotation relative to said large rotatable wheel, each of said smaller rotatable wheels carrying randomly arranged indica on a respective front surface indicative of a portion of a complete second deck of cards;

and means for simultaneously driving said large rotatable wheel and said plurality of smaller rotatable wheels at respectively different rates of speed for a time period controlled by said dealer; whereby poker and other games of chance may be played by said players by identifying selected card images on said large and smaller rotatable wheels.

2. A game apparatus as in claim 1, further comprising:

a rotatable marker wheel mounted for rotation on said front surface of said large rotatable wheel and coaxially with said large rotatable wheel;

a plurality of spring markers carried by said rotatable marker wheel for cooperation with pins carried by said plurality of smaller rotatable wheels to identify a particular card image on each of said plurality of smaller rotatable wheels when said large rotatable wheel and said plurality of smaller rotatable wheels stop rotating; and a stationary spring marker located adjacent said large rotatable wheel for cooperation with pins carried by said large rotatable wheel to identify a particular card image on said large rotatable wheel when said large rotatable wheel and said plurality of smaller rotatable wheels stop rotating; whereby selected card images on each of said wheels can be easily identified.

3. A game apparatus as in claim 2, wherein said plurality of smaller rotatable wheels is limited to four smaller rotatable wheels including images of thirteen cards randomly selected from a second complete deck of cards, whereby five cards are identified with each rotation of said wheels.

4. A game apparatus as in claim 3, wherein suits of the card images on said large rotatable wheel and said plurality of smaller rotatable wheels are specifically and repeatedly arranged in the order of diamond, club, heart and spade so as to repeatedly alternate between a red and a black card.

5. A game apparatus as in claim 4, said means for simultaneously driving said large rotatable wheel and said plurality of smaller rotatable wheels comprises:

an electric motor actuated by one of said plurality of switch means for any desired amount of time determined by the dealer, said motor being mounted on said movable stand and connected to a reduction gear box having an output sprocket;

a main shaft supporting said large rotatable wheel and mounted on a pair of A-frames connected to said movable stand;

a second shaft mounted on said pair of A-frames below said main shaft;

a first chain connected to said output sprocket, to a second sprocket on said main shaft and to a third sprocket on said second shaft, whereby said main shaft and said second shaft are rotated when said electric motor is actuated;

a fourth sprocket mounted on one end of said second shaft;

a bushing having a fifth sprocket and a sixth sprocket rotatably mounted on said main shaft;

a second chain connected between said fourth sprocket and said fifth sprocket, whereby said bushing is rotated relative to said main shaft when said electric motor is operated;

a third chain connected between said sixth sprocket and a seventh sprocket mounted on a shaft supporting one of said plurality of smaller rotatable wheels;

an eighth sprocket connected to said shaft supporting said one of said plurality of smaller rotatable wheels;

and a fourth chain connected to said eighth sprocket and to a sprocket mounted on a respective supporting shaft of each of the remaining smaller rotatable wheels of said plurality of rotatable wheels, said eighth sprocket and said sprockets mounted on the respective supporting shafts being of different sizes; whereby said large rotatable wheel and said plurality of smaller rotatable wheels rotate at different speeds when said electric motor is actuated.

6. A game apparatus as in claim 3, said means for simultaneously driving said large rotatable wheel and said plurality of smaller rotatable wheels comprises:

an electric motor actuated by one of said plurality of switch means for any desired amount of time determined by the dealer, said motor being mounted on said movable stand and connected to a reduction gear box having an output sprocket;

a main shaft supporting said large rotatable wheel and mounted on a pair of A-frames connected to said movable stand;

a second shaft mounted on said pair of A-frames below said main shaft;

a first chain connected to said output sprocket, to a second sprocket on said main shaft and to a third sprocket on said second shaft, whereby said main shaft and said second shaft are rotated when said electric motor is actuated;

a fourth sprocket mounted on one end of said second shaft;

a bushing having a fifth sprocket and a sixth sprocket rotatably mounted on said main shaft;

a second chain connected between said fourth sprocket and said fifth sprocket, whereby said bushing is rotated relative to said main shaft when said electric motor is operated;

a third chain connected between said sixth sprocket and a seventh sprocket mounted on a shaft supporting one of said plurality of smaller rotatable wheels;

an eighth sprocket connected to said shaft supporting said one of said plurality of smaller rotatable wheels;

and a fourth chain connected to said eighth sprocket and to a sprocket mounted on a respective supporting shaft of each of the remaining smaller rotatable wheels of said plurality of rotatable wheels, said eighth sprocket and said sprockets mounted on the respective supporting shafts being of different sizes; whereby said large rotatable wheel and said plurality of smaller rotatable wheels rotate at different speeds when said electric motor is actuated.

7. A game apparatus as in claim 2, wherein suits of the card images on said large rotatable wheel and said plurality of smaller rotatable wheels are specifically and repeatedly arranged in the order of diamond, club, heart and spade so as to repeatedly alternate between a red and a black card.

8. A game apparatus as in claim 7, said means for simultaneously driving said large rotatable wheel and said plurality of smaller rotatable wheels comprises:

an electric motor actuated by one of said plurality of switch means for any desired amount of time determined by the dealer, said motor being mounted on said movable stand and connected to a reduction gear box having an output sprocket;

a main shaft supporting said large rotatable wheel and mounted on a pair of A-frames conneced to said movable stand;

a second shaft mounted on said pair of A-frames below said main shaft;

a first chain connected to said output sprocket, to a second sprocket on said main shaft and to a third sprocket on said second shaft, whereby said main shaft and said second shaft are rotated when said electric motor is actuated;

a fourth sprocket mounted on one end of said second shaft;

a bushing having a fifth sprocket and a sixth sprocket rotatably mounted on said main shaft;

a second chain connected between said fourth sprocket and said fifth sprocket, whereby said bushing is rotated relative to said main shaft when said electric motor is operated;

a third chain connected between said sixth sprocket and a seventh sprocket mounted on a shaft supporting one of said plurality of smaller rotatable wheels;

an eighth sprocket connected to said shaft supporting said one of said plurality of smaller rotatable wheels;

and a fourth chain connected to said eighth sprocket and to a sprocket mounted on a respective supporting shaft of each of the remaining smaller rotatable wheels of said plurality of rotatable wheels, said eighth sprocket and said sprockets mounted on the respective supporting shafts being of different sizes; whereby said large rotatable wheel and said plurality of smaller rotatable wheels rotate at different speeds when said electric motor is actuated.

9. A game apparatus as in claim 2, said means for simultaneously driving said large rotatable wheel and said plurality of smaller rotatable wheels comprises:

an electric motor actuated by one of said plurality of switch means for any desired amount of time determined by the dealer, said motor being mounted on said movable stand and connected to a reduction gear box having an output sprocket;

a main shaft supporting said large rotatable wheel and mounted on a pair of A-frames connected to said movable stand;

a second shaft mounted on said pair of A-frames below said main shaft;

a first chain connected to said output sprocket, to a second sprocket on said main shaft and to a third sprocket on said second shaft, whereby said main shaft and said second shaft are rotated when said electric motor is actuated;

a fourth sprocket mounted on one end of said second shaft;

a bushing having a fifth sprocket and a sixth sprocket rotatably mounted on said main shaft;

a second chain connected between said fourth sprocket and said fifth sprocket, whereby said bushing is rotated relative to said main shaft when said electric motor is operated;

a third chain connected between said sixth sprocket and a seventh sprocket mounted on a shaft supporting one of said plurality of smaller rotatable wheels;

an eighth sprocket connected to said shaft supporting said one of said plurality of smaller rotatable wheels;

and a fourth chain connected to said eighth sprocket and to a sprocket mounted on a respective supporting shaft of each of the remaining smaller rotatable wheels of said plurality of rotatable wheels, and eighth sprocket and said sprockets mounted on the respective supporting shafts being of different sizes; whereby said larger rotatable wheel and said plurality of smaller rotatable wheels rotate at different speeds when said electric motor is actuated.

10. A game appartus as in claim 1, wherein said plurality of smaller rotatable wheels is limited to four smaller rotatable wheels, each of said four smaller rotatable wheels including images of thirteen cards randomly selected from a second complete deck of cards, whereby five cards are identified with each rotation of said wheels.

11. A game apparatus as in claim 10, wherein suits of the card images on said large rotatable wheel and said plurality of smaller rotatable wheels are specifically and repeatedly arranged in the order of diamond, club, heart and spade so as to repeatedly alternate between a red and a black card.

12. A game apparatus as in claim 11, said means for simultaneously driving said large rotatable wheel and said plurality of smaller rotatable wheels comprises:

an electric motor actuated by one of said plurality of switch means for any desired amount of time determined by the dealer, said motor being mounted on said moveable stand and connected to a reduction gear box having an output sprocket;

a main shaft supporting said large rotatable wheel and mounted on a pair a A-frames connected to said moveable stand;

a second shaft mounted on said pair of A-frames below said main shaft;

a first chain connected to said output sprocket, to a second sprocket on said main shaft and to a third sprocket on said second shaft, whereby said main shaft and said second shaft are rotated when said electric motor is actuated;

a fourth sprocket mounted on one end of said second shaft;

a bushing having a fifth sprocket and a sixth sprocket rotatably mounted on said main shaft;

a second chain connected between said fourth sprocket and said fifth sprocket, whereby said bushing is rotated relative to said main shaft when said eletric motor is operated;

a third chain connected between said sixth sprocket and a seventh sprocket mounted on a shaft supporting one of said plurality of smaller rotatable wheels;

an eighth sprocket connected to said shaft supporting said one of said plurality of smaller rotatable wheels;

and a fourth chain connected to said eighth sprocket and to a sprocket mounted on a respective supporting shaft of each of the remaining smaller rotatable wheels of said plurality of rotatable wheels, said eighth sprocket and said sprockets mounted on the respective supporting shafts being of different sizes; whereby said large rotatable wheel and said plurality of smaller rotatable wheels rotate at different speeds when said electric motor is actuated.

13. A game apparatus as a claim 10, said means for simultaneously driving said large rotatable wheel and said plurality of smaller rotatable wheels comprises:

an electric motor actuated by one of said plurality of switch means for any desired amount of time determined by the dealer, said motor being mounted on said movable stand and connected to a reduction gear box having an output sprocket;

a main shaft supporting said large rotatable wheel and mounted on a pair of A-frames connected to said movable stand;

a second shaft mounted on said pair of A-frames below said main shaft;

a first chain connected to said output sprocket, to a second sprocket on said main shaft and to a third sprocket on said second shaft, whereby said main shaft and said second shaft are rotated when said electric motor is actuated;

a fourth sprocket mounted on one end of said second shaft;

a bushing having a fifth sprocket and a sixth sprocket rotatably mounted on said main shaft;

a second chain connected between said fourth sprocket and said fifth sprocket, whereby said bushing is rotated relative to said main shaft when said electric motor is operated;

a third chain connected between said sixth sprocket and a seventh sprocket mounted on a shaft supporting one of said plurality of smaller rotatable wheels;

an eighth sprocket connected to said shaft supporting said one of said plurality of smaller rotatable wheels;

and a fourth chain connected to said eighth sprocket and to a sprocket mounted on a respective supporting shaft of each of the remaining smaller rotatable wheels of said plurality of rotatable wheels, said eighth sprocket and said sprockets mounted on the respective supporting shafts being of different sizes; whereby said large rotatable wheel and said plurality of smaller rotatable wheels rotate at different speeds when said electric motor is actuated.

14. A game apparatus as in claim 1, wherein suits of the card images on said large rotatable wheel and said plurality of smaller rotatable wheels are specifically and repeatedly arranged in the order of diamond, club, heart and spade so as to repeatedly alternate between a red and a black card.

15. A game apparatus as in claim 14, said means for simultaneously driving said large rotatable wheel and said plurality of smaller rotatable wheels comprises:

an electric motor actuated by one of said plurality of switch means for any desired amount of time determined by the dealer, said motor being mounted on said movable stand and connected to a reduction gear box having an output sprocket;

a main shaft supporting said large rotatable wheel and mounted on a pair of A-frames connected to said movable stand;

a second shaft mounted on said pair of A-frames below said main shaft;

a first chain connected to said output sprocket, to a second sprocket on said main shaft and to a third sprocket on said second shaft, whereby said main shaft and said second shaft are rotated when said electric motor is actuated;

a fourth sprocket mounted on one end of said second shaft;

a bushing having a fifth sprocket and a sixth sprocket rotatably mounted on said main shaft;

a second chain connected between said fourth sprocket and said fifth sprocket, whereby said bushing is rotated relative to said main shaft when said electric motor is operated;

a third chain connected between said sixth sprocket and a seventh sprocket mounted on a shaft supporting one of said plurality of smaller rotatable wheels;

an eighth sprocket connected to said shaft supporting said one of said plurality of smaller rotatable wheels;

and a fourth chain connected to said eighth sprocket and to a sprocket mounted on a respective supporting shaft of each of the remaining smaller rotatable wheels of said plurality of rotatable wheels, said eighth sprocket and said sprockets mounted on the respective supporting shafts being of different sizes; whereby said large rotatable wheel and said plurality of smaller rotatable wheels rotate at different speeds when said electric motor is actuated.

16. A game apparatus as in claim 1, said means for simultaneously driving said large rotatable wheel and said plurality of smaller rotatable wheels comprises:

an electric motor actuated by one of said plurality of switch means for any desired amount of time determined by the dealer, said motor being mounted on said movable stand and connected to a reduction gear box having an output sprocket;

a main shaft supporting said large rotatable wheel and mounted on a pair of A-frames connected to said movable stand;

a second shaft mounted on said pair of A-frames below said main-shaft;

a first chain connected to said output sprocket, to a second sprocket on said main shaft and to a third sprocket on said second shaft, whereby said main shaft and said second shaft are rotated when said electric motor is actuated;

a fourth sprocket mounted on one end of said second shaft;

a bushing having a fifth sprocket and a sixth sprocket rotatably mounted on said main shaft;

a second chain connected between said fourth sprocket and said fifth sprocket, whereby said bushing is rotated relative to said main shaft when said electric motor is operated;

a third chain connected between said sixth sprocket and a seventh sprocket mounted on a shaft supporting one of said plurality of smaller rotatable wheels;

an eighth sprocket connected to said shaft supporting said one of said plurality of smaller rotatable wheels;

and a fourth chain connected to said eighth sprocket and to a sprocket mounted on a respective supporting shaft of each of the remaining smaller rotatable wheels of said plurality of rotatable wheels, said eighth sprocket and said sprockets mounted on the respective supporting shafts being of different sizes; whereby said large rotatable wheel and said plurality of smaller rotatable wheels rotate at different speeds when said electric motor is actuated.

17. A game apparatus as in claim 1, said means for simultaneously driving said large rotatable wheel and said plurality of smaller rotatable wheels comprises:

an electric motor actuated by one of said plurality of switch means for any desired amount of time determined by the dealer, said motor being mounted on said movable stand and connected to a reduction gear box having an output sprocket;

a main shaft supporting said large rotatable wheel;

a second shaft disposed below said main shaft;

said main shaft and said second shaft being supported on a pair of A-frames mounted on said movable stand;

a plurality of shafts mounted on said large wheel for rotatably supporting said plurality of smaller rotatable wheels;

each of said shafts having at least one sprocket mounted thereon; and a plurality of chain means connecting said sprockets mounted on said shafts to said output sprocket in serial fashion, at least some of said sprockets being of different sizes; whereby said large rotatable wheels and said plurality of smaller rotatable wheels simultaneously rotate at different speeds when said electric motor is actuated.

18. A game apparatus as in claim 1, said indicator board including a plurality of LEDS controlled by said plurality of switch means to form an image of an identified card on said rotatable wheels.

* * * * *